United States Patent [19]

McGuire

[11] Patent Number: 4,947,601

[45] Date of Patent: Aug. 14, 1990

[54] WALL PANEL TRIM SYSTEM AND METHOD

[75] Inventor: Robert L. McGuire, Kansas City, Mo.

[73] Assignee: Glen O'Brien Movable Partition Co., Inc., Kansas City, Mo.

[21] Appl. No.: 382,536

[22] Filed: Jul. 18, 1989

[51] Int. Cl.[5] ..... E04H 1/00

[52] U.S. Cl. ..... 52/239; 52/241; 52/281

[58] Field of Search ..... 52/239, 241, 285, 281

[56] References Cited

U.S. PATENT DOCUMENTS

| | | | |
|---|---|---|---|
| Re. 32,890 | 3/1989 | DeFouw et al. | 52/239 |
| 3,999,342 | 12/1976 | Kaulfuss et al. | 52/236 |
| 4,047,342 | 9/1977 | Boulva | 52/239 |
| 4,118,903 | 10/1978 | Coulthard | 52/239 X |
| 4,269,005 | 5/1981 | Timmons | 52/241 X |
| 4,597,231 | 7/1986 | Quest | 52/285 X |
| 4,771,583 | 9/1988 | Ball et al. | 52/239 X |

*Primary Examiner*—David A. Scherbel
*Assistant Examiner*—Linda J. Hoffert
*Attorney, Agent, or Firm*—Litman, McMahon & Brown

[57] ABSTRACT

A trim system for a wall panel system including first and second panels each having upper, lower and opposite side edges and opposite faces, the panels being connected with respective side edges located adjacent to each other. The trim system includes edge caps for mounting on the panel upper and side edges and includes a plurality of intersection caps adapted for joining the edge caps at panel intersections. The intersection caps have configurations which correspond to various configurations of the panel intersections, such as right angle, three-way tee, four-way cross and obtuse angle. A method of trimming a wall system includes the steps of placing panels in configurations with respective panel side edges adjacent to each other, inserting edge caps into intersection caps, placing the intersection caps over the panel intersections, placing the edge caps over the panel edges, and snapping the panel edge caps into releasable engagement with the panel edges.

29 Claims, 5 Drawing Sheets

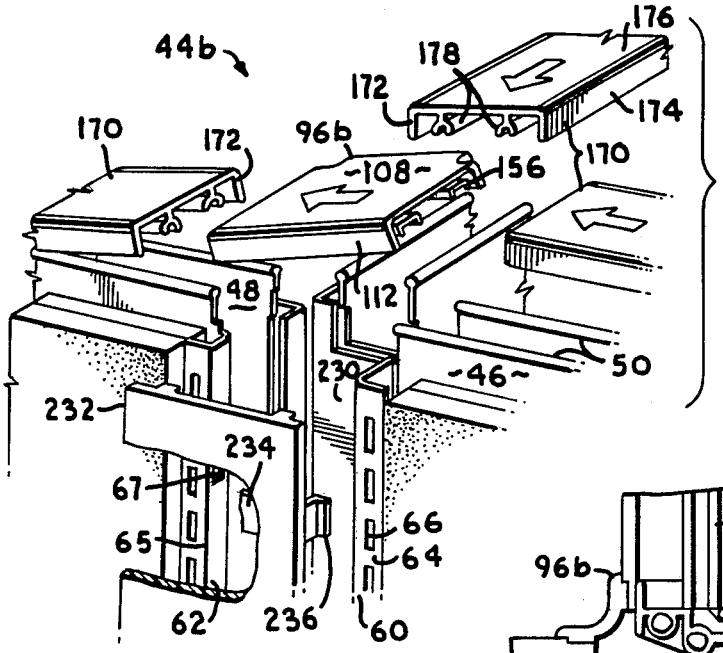
Fig. 5.
Fig. 6.
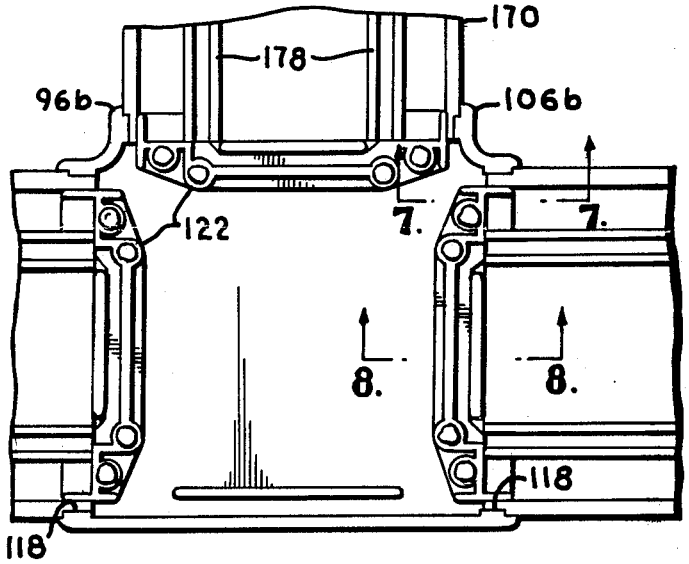
Fig. 7.
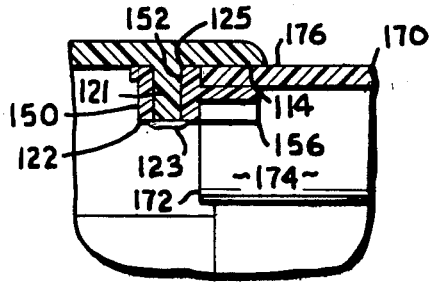
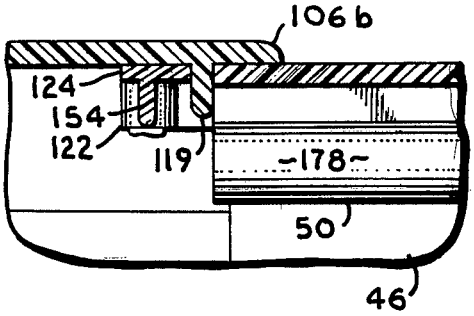
Fig. 8.

Fig. 9.
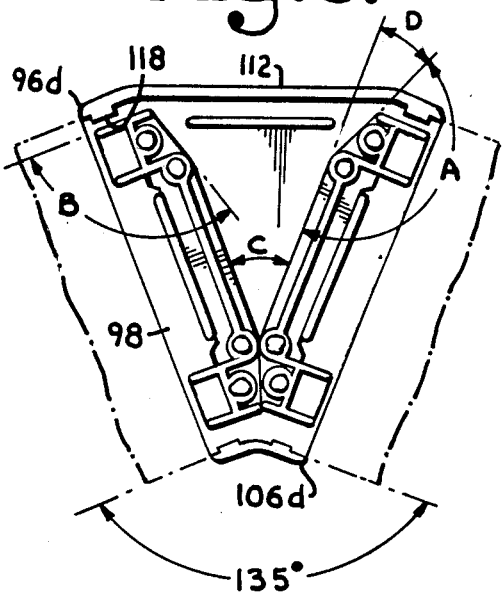
Fig. 10.
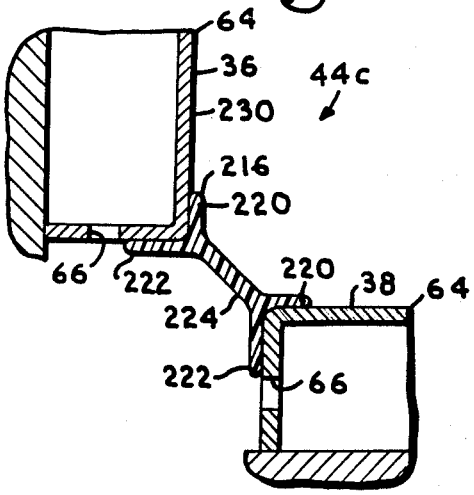
Fig. 11.
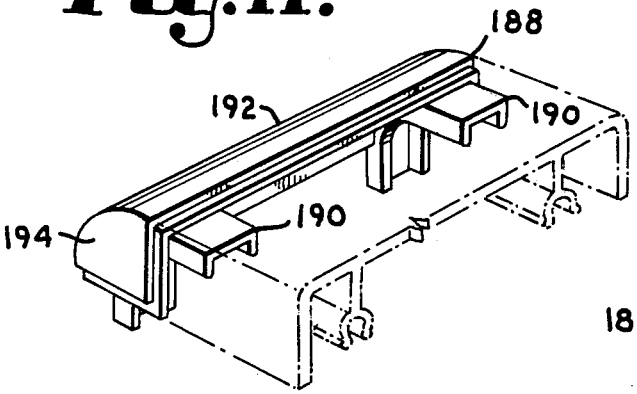
Fig. 12.
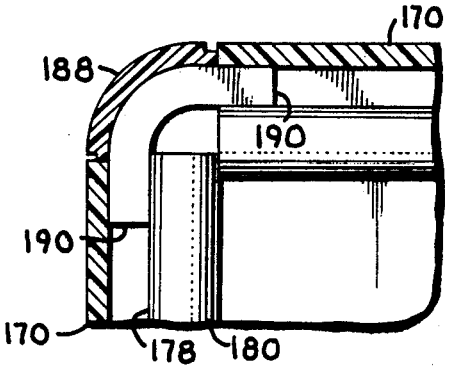
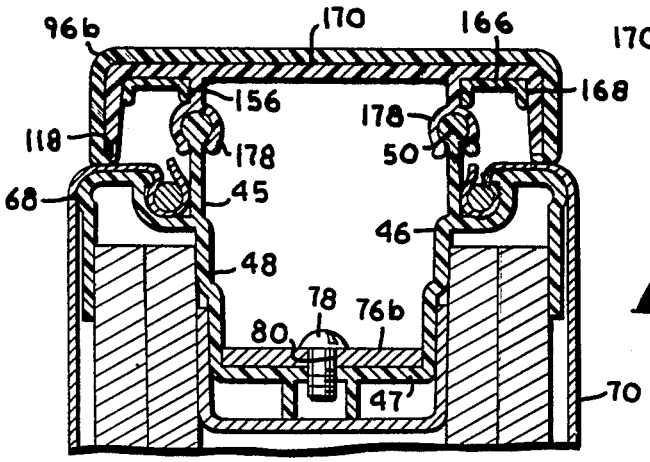
Fig. 13.

Fig. 14.
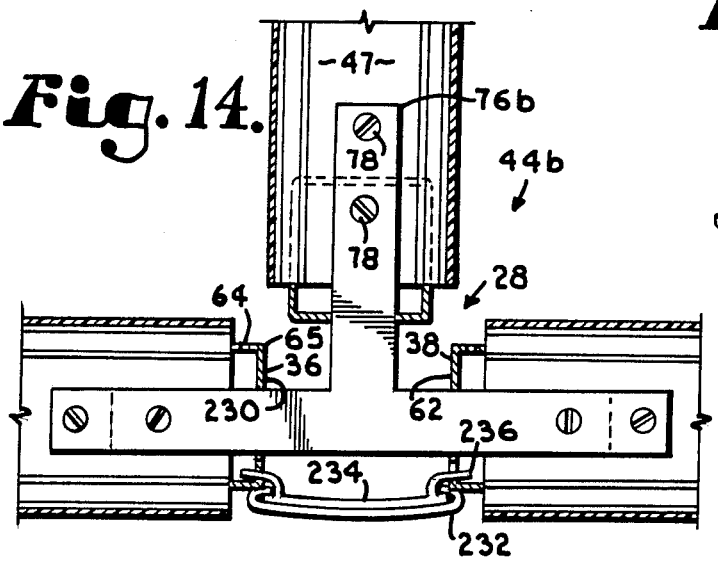
Fig. 16b.
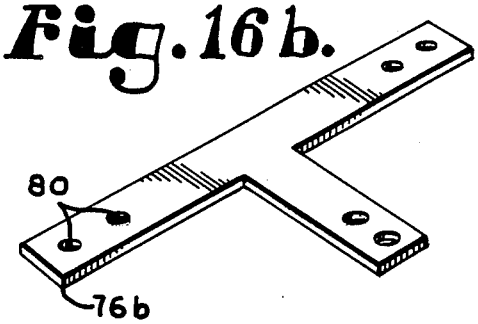
Fig. 15.
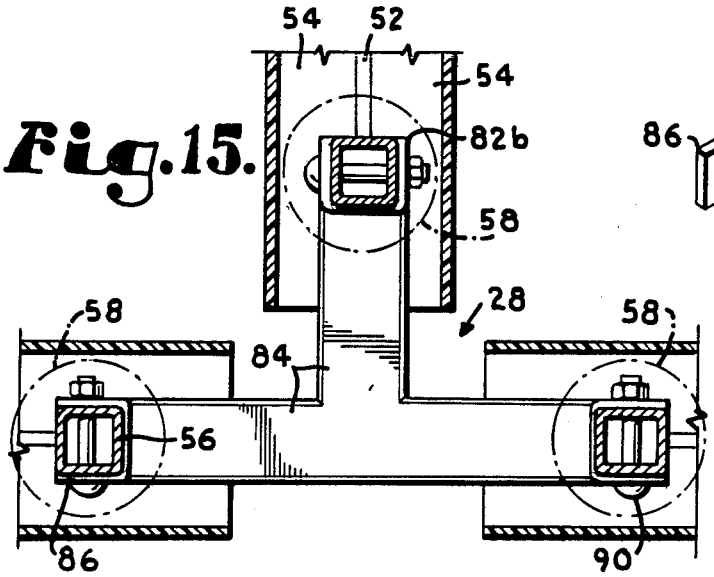
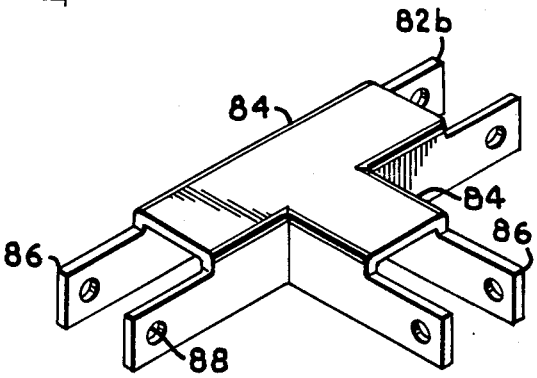
Fig. 17b.
Fig. 17a.
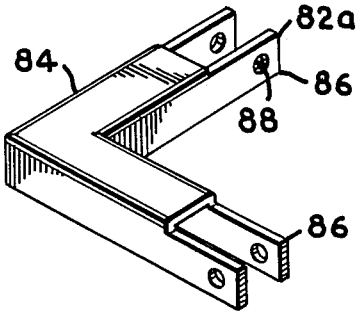
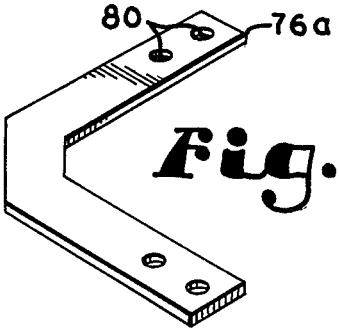
Fig. 16a.

Fig. 17e.
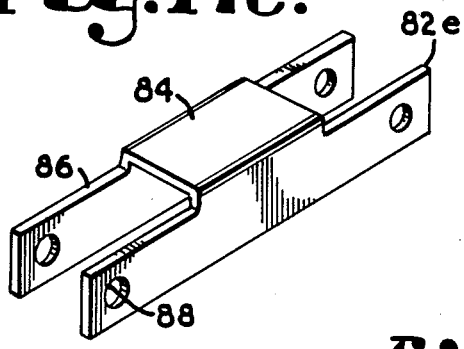
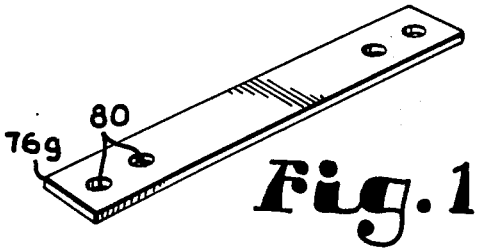
Fig. 16g.
Fig. 16c.
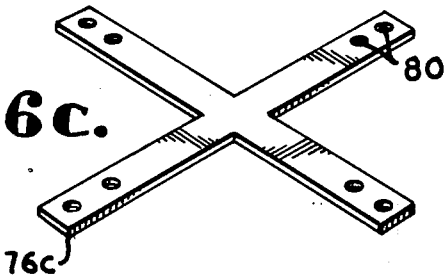
Fig. 17c.
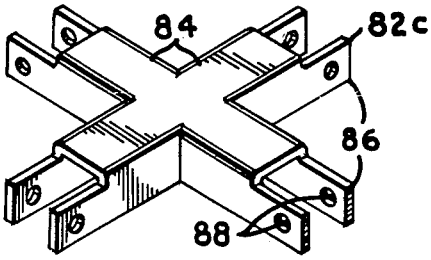
Fig. 16d.
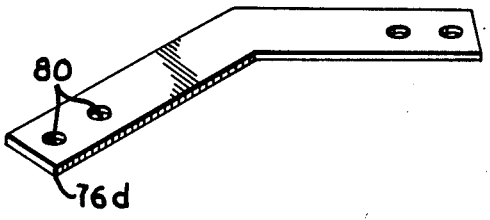
Fig. 17d.
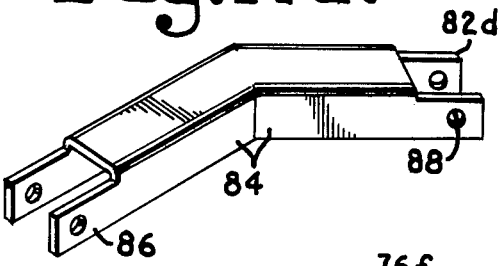
Fig. 16e.
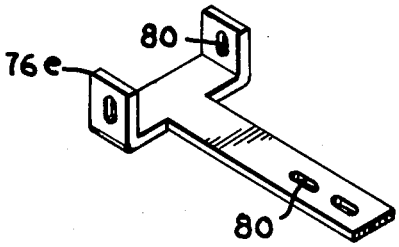
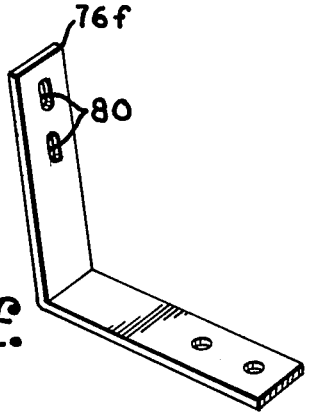
Fig. 16f.

WALL PANEL TRIM SYSTEM AND METHOD

BACKGROUND OF THE INVENTION

1. Field of the Invention

The present invention relates generally to trim systems and, in particular, to a trim system for movable wall panel or partition systems, and an installation method therefor.

2. Description of the Prior Art

Movable wall panel or partition systems have been extensively employed to form work stations, to isolate and partially enclose equipment, to provide visual and acoustical privacy, and for other purposes. Relocatable wall panels can range in height from a maximum height extending to a ceiling above (i.e. full-height) to relatively low panels barely more than the height of a desk surface. Relocatable wall panels designed for open-plan offices often have heights between these extremes (i.e. in the range of about 42 inches high to about 84 inches high. Such panels can be free standing in the sense that they are not structurally attached to either the ceiling or the floor of the space that they occupy.

Free standing, relocatable partitions have several important advantages over permanent, full-height walls. Flexibility is one important advantage since many such movable wall systems are designed for expeditious installation and removal. Often such systems require little or no permanent attachment to or modification of the structure. Relocation can often be accomplished with relatively simple tools and with relatively little, if any, assistance from skilled workers in the building trades. Greater quality control may be experienced with movable partition systems prefabricated under controlled manufacturing conditions, as compared to permanent wall systems built in situ using conventional construction techniques.

Yet another advantage of relocatable partitions is that air circulation for heating, cooling and ventilating purposes can sometimes be provided in a more efficient manner than is possible with conventional full-height permanent walls. Likewise, uniform distribution of overhead lighting may be facilitated by an open plan system. Speed of installation, relocatability to other buildings and the aesthetic benefits of a more "open" environment are other advantages. Furthermore, in some situations, movable wall partition systems tend to provide more efficient space utilization than conventional, permanent walls.

Removable wall systems are generally becoming acceptable in more building code jurisdictions; and in many locations, the panels can be prewired to meet the electrical needs of office equipment located in the work stations partially enclosed by the wall panels.

A persistent problem in the field of movable wall panels relates to their need for a systems approach whereby relatively few standard components can be utilized to create a wide variety of planned configurations, and the need for design flexibility to accommodate as many different facility requirements as possible. In an effort to accommodate both of these objectives, wall panels and their components have been designed as systems which can form various different configurations. For example, panel heights, work station sizes, furniture, fixtures and material finish selections are all variables that can be taken into account by the system designers.

The trim system and installation method of the present invention address the aforementioned problems by providing certain standard or universal trim components which, when combined with certain other configuration-specific components, can accommodate various panel intersection conditions.

SUMMARY OF THE INVENTION

In the practice of the present invention, a trim system is provided for a wall panel system including first and second panels each having upper, lower and opposite side edges and opposite faces. The panels are interconnected whereby respective side edges are adjacent to each other at panel intersections. The trim system includes edge caps for placement on the panel upper and side edges, and intersection caps for placement at panel intersections. The intersection caps can include covers with openings for receiving the ends of the edge caps, and clips for mounting on the covers for retaining the edge cap ends. The cap mounting clips can be of a common or universal design to accommodate intersection caps of different configurations corresponding to the configurations of the panel intersections, e.g. right angle, three-way tee, four-way cross and obtuse angle.

A trim installation method is provided which includes the steps of placing the edge cap ends in intersection caps and pressing the edge caps into releasable engagement with the panel edges.

OBJECTS AND ADVANTAGES OF THE INVENTION

The principal objects and advantages of the present invention include providing a trim system for a movable wall panel; providing such a trim system which is particularly well adapted for prefabricated wall panel systems, providing such a trim system which can be installed relatively quickly and easily; providing such a trim system which can be installed with relatively little special training and instruction; providing such a trim system which utilizes a certain standard or universal component; providing such a trim system which can accommodate various wall panel intersection configurations; providing such a trim system which is economical in operation, efficient in operation, capable of a long operating life and particularly well adapted for the proposed usage thereof; providing a method of installing trim on movable wall panels; providing such a method which can be expeditiously performed without special tools; and providing such a method which produces aesthetically pleasing results.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a fragmentary, top perspective view of a wall panel intersection particularly showing the procedure for installing the components of the trim system.

FIG. 6 is a fragmentary bottom plan view of the assembled trim system.

FIG. 7 is an enlarged, fragmentary, vertical, crosssectional view of the trim system, taken generally along line 7—7 in FIG. 6.

FIG. 8 is an enlarged, fragmentary, vertical, crosssectional sectional view of the trim system, taken generally along line 8—8 in FIG. 6.

FIG. 9 is a bottom plan view of an intersection cap for a 135° obtuse angle intersection.

FIG. 10 is an enlarged, fragmentary, horizontal crossectional sectional view of a four-way cross intersection, particularly showing an edge-sealing gasket and taken generally along line 10—10 in FIG. 1.

FIG. 11 is a top perspective view of an end or corner cap 188.

FIG. 12 is an enlarged, fragmentary, vertical, crossectional sectional view of a panel outside corner, particularly showing the end or corner cap and taken generally along line 12—12 in FIG. 1.

FIG. 13 is an enlarged, fragmentary, vertical, crossectional sectional view of the trim system, taken generally along line 13—13 in FIG. 1.

FIG. 14 is an enlarged, fragmentary, horizontal, crossectional sectional view of the trim system, taken generally along line 14—14 in FIG. 1 and particularly showing an upper connector at a three-way tee intersection.

FIG. 15 is an enlarged, fragmentary, horizontal, crossectional sectional view of the wall panel system, taken generally along line 15—15 in FIG. 1 and particularly showing a lower connecting bracket for the three-way tee intersection.

FIG. 16*a* is a top perspective view of an upper connecting member for a 90° or right angle panel intersection.

FIG. 16*b* is a top perspective view of an upper connecting member for a three-way tee intersection.

FIG. 16*c* is a top perspective view of an upper connecting member for a four-way cross intersection.

FIG. 16*d* is a top perspective view of an upper connecting member for a 135° obtuse angle intersection.

FIG. 16*e* is a top perspective view of an upper connecting member for a three-way, multi-height intersection.

FIG. 16*f* is a top perspective view of an upper connecting member for a straight line multi-height panel intersection a wall intersection.

FIG. 16*g* is a top perspective view of an upper connecting for a straight line intersection.

FIG. 17*a* is a top perspective view of a lower connecting bracket for a 90° or right angle intersection.

FIG. 17*b* is a top perspective view of a lower connecting bracket for a three-way tee intersection.

FIG. 17*c* is a top perspective view of a lower connecting bracket for a four-way cross intersection.

FIG. 17*d* is a top perspective view of a lower connecting bracket for a 135° obtuse angle intersection.

FIG. 17*e* is a top perspective view of a lower connecting bracket for a straight line intersection.

DETAILED DESCRIPTION OF THE PREFERRED EMBODIMENTS

Figure 1:
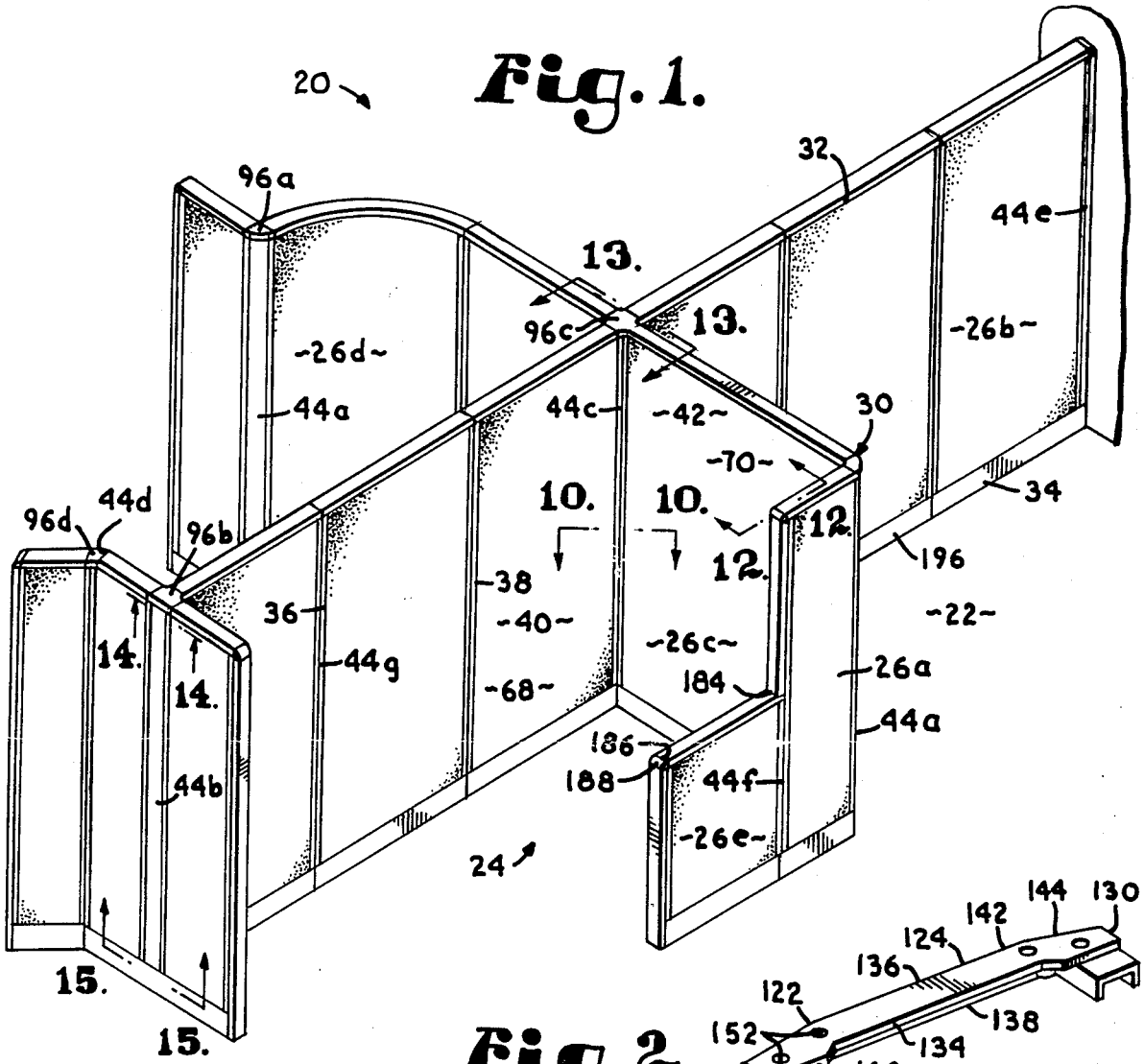
FIG. 1 is a top perspective view of a wall panel system with a trim system embodying the present invention.

I. Introduction and Environment.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience and reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts thereof. Said terminology will include the words specifically mentioned, derivatives thereof and words of similar import.

Referring to the drawings in more detail, the reference numeral 20 generally designates a wall panel or partition system embodying the present invention. The system 20 may be free-standing or freely-supported on a floor surface 22, and may be utilized to subdivide an enclosed area, e.g. in an office building, into multiple discrete work stations or cubicles 24. The cubicles 24 can include various furniture and fixtures, such as desks, work surfaces, shelving units, seating, etc.; and can also include various equipment for the activities conducted therein. The panel system 20 can provide support for certain built-in and modular units mounted thereon. Alternatively, free-standing furiture can be placed in the cubicles 24 whereby the panel system 20 primarily functions to partition the cubicles 24 from each other and to provide a degree of visual and acoustical privacy. Such fixtures, furniture, units and equipment are not shown.

The office arrangement defined by the wall system 20 is sometimes referred to in the trade as an "open plan" office arrangement, which can be understood to mean that the partitions do not extend full height to the ceiling above and that doors are not generally provided for ingress and egress. Wall panel systems such as that shown at 20 can be configured in practically an unlimited variety of layouts.

The wall system 20 generally comprises a plurality of discrete panels **26*a*–26*e*, a structural connecting subsystem 28 innerconnecting the panels 26*a*–26*e*, and a trim subsystem 30** for finishing and concealing the panel edges and intersections.

II. Panels **26*a*–26*e***.

The panel system 20 includes narrow, medium width and wide panels **26*a*, 26*b*, 26*c*; a curved panel 26*d* and a short panel 26*e*. However, panels of various widths and configurations could be successfully employed with the system of the present invention, and a variety of such sizes and configurations might be offered to accommodate various panel system configurations. Each panel 26*a*–26*e* includes upper and lower edges 32, 34; opposite first and second side edges 36, 38; and opposite first and second faces 40, 42**.

Respective adjacent panel side edges 36, 38 are interconnected at panel intersections 44a–44g. Exemplary panel intersections include right angle or ninety degree 44a, tee or three-way 44b, four-way cross 44c, one hundred thirty-five degree obtuse angle 44d, permanent wall 44e, straight line multi-height 44f and straight line 44g. A wide variety of other intersection configurations could be accommodated with the trim system 30 of the present invention. Each panel 26a–26e can include a generally rectangular (curved in the case of curved panel 26d) subframe (not shown). An upwardly open upper channel 46 is mounted on top of the subframe and forms a longitudinallyextending raceway 48. Wiring (not shown) for communications cables and the like can be run in the upper raceway 48. Each upper channel 46 includes a parallel, longitudinallyextending pair of side flanges 45 extending upwardly from a bottom or connecting flange 47 and terminating at respective upper beaded edges 50.

At the panel lower edge 34 an I-member 52 is mounted on the subframe and forms a pair of parallel, longitudinally extending lower raceways 54, each accessible from a respective panel face 40, 42 and each being adapted to receive electrical power cables, wiring and the like, which can be attached to electrical power junction boxes (not shown) mounted in or on the I-member 52. Each panel 26a–26e includes a pair of square-tubular legs 56 extending downwardly from its lower edge 34 adjacent the first and second side edges 36, 38 and threadably mounting a foot 58 for panel height adjustment and alignment.

At each side edge 36, 38 a side standard 60 is mounted on the subframe and includes a pair of transversely-spaced, vertically-extending side flanges 62 projecting inwardly from a transverse, connecting flange 64. Each side flange 62 includes a plurality of vertically-aligned, closelyspaced side slots 66 and end slots 67.

First and second wallboards 68, 70 are mounted at the first and second faces 40, 42 respectively and can comprise sheets or panels of acoustical material covered by fabric. The interior of the panel can include acoustical insulation (not shown) within the subframe and between the wallboards 68, 70. A pair of vertically extending corner edges 65 are formed by each side standard 60 at the intersections of its side flanges 62 and connecting flange 64.

III. Structural Connecting Subsystem 28.

The structural connecting subsystem 28 includes upper connecting members 76a–76g (FIGS. 16a–16g) comprising a right angle or ninety-degree member 76a, a tee or three-way member 76b, a four-way cross member 76c, a one hundred thirty-five degree obtuse angle connector 76d, a three-way multi-height connector 76e, a multi-height straight line or wall connector 76f, and a straight line member 76g. The upper connecting members 76a–76g are adapted for placement in the upper channels 46 where they are screwed to the upper channel bottom flanges 47 by screws 78 received in screw receivers 80 formed in the respective legs of the upper connecting members 76a–76g.

The three-way multi-height connector 76e (FIG. 17e) is adapted for attachment to the side standards 60 of an aligned pair of taller panels and the upper channel 46 of a shorter panel meeting the taller panels at a 90° tee intersection (not shown).

The structural connecting system 28 also includes a plurality of lower connecting brackets 82a–82e with various configurations for interconnecting the adjacent legs 56 at the panel intersections 44a–44g. The lower connecting bracket configurations include a right angle or ninetydegree bracket 86a, a tee or three-way bracket 86b, four-way cross bracket 86c, a one hundred and thirty-five degree obtuse angle bracket 86d and a straight line bracket 86e.

The lower connecting brackets 82a–82e each have downwardly-open channel-configuration center portions 84 and clevis-type end portions 86 with pairs of opposed receivers 88 for receiving mounting screws 90 which are threadably received in the legs 56.

IV. Trim Subsystem 30.

The trim subsystem 30 includes a plurality of inner-section caps 96a–96e comprising: a right angle or ninety-degree cap 96a, a tee or three-way cap 96b, a four-way cross cap 96c and a one hundred thirty-five degree obtuse angle cap 96d. Each intersection cap 96a–96d includes ends 98 corresponding to the number of panels which intersect thereunder, i.e. two ends each for caps 96a and 96d, three ends for cap 96b and four ends for cap 96c. Each cap 96a–96d generally includes a cover 106a–106d with a top 107 including upper and lower surfaces 108, 110 and a perimeter side wall 112 comprising discrete side wall portions forming end openings 114 at the ends 98. The perimeter side walls 112 terminate at lower margins 116 of the covers 106a–106d. A pair of retainer lips 118 project inwardly from the cover side walls 112 on both sides of the openings 114 adjacent the cover lower margins 116. Each intersection cap 96a–96d forms a cavity 120 which is downwardly-open and also open at respective end openings 114.

The covers 106a–106d include multiple stop bars 119 each depending downwardly from a respective cover top lower surface 110 and extending transversely in parallel, spaced relation inwardly from a respective end opening 114. Each cover 106a–106d includes a plurality of clip mounting pins 121 projecting downwardly from its lower surface 110 into the cavity 120. Inner and outer pairs of clip mounting pins 121 are associated with each cap end opening 114 and are staggered longitudinally.

The trim subsystem 30 is designed for common or universal cap mounting clips 122 to be used with all of the differently-configured intersection caps 96a–96d. Each cap mounting clip 122 generally comprises a clip base 124 including: upper and lower surfaces 126, 128; opposite ends 130 at ends 132 of the clip 122; and front and back edges 134, 136. The front edge 134 includes a recessed center portion 138 and a pair of opposite side portions 140. The back edge 136 includes a center portion 142 and a pair of back edge side portions 144 which form mitered corners 146 with respect to the clip ends 132 and the clip inner edges 136. For purposes that will be explained in more detail hereinafter, the mitered corners 146 include obtuse angles "A" of approximately 157.5° between the inner edge center and side portions 142, 144, and obtuse angles "B" of approximately 112.5° with respect to the clip ends 132 and the inner edge side portions 140.

The inner edge center portions 142 can be approximately equal in width to the stop bars 119, which they can be placed against or adjacent to.

The cap mounting clip 122 includes inner and outer pairs of pin bosses 148, 150 with respective pin receivers 152 adapted for alignment with clip mounting pins 121. The inner pin bosses 148 are located in proximity to the angular intersections of the clip inner edge center and side portions 142, 144. The outer pin bosses 150 are spaced longitudinally and transversely outwardly from the inner pin bosses 148. A transversely-extending rib 154 interconnects the inner pin bosses 148 and projects downwardly from the clip base lower surface 128.

Figure 2:
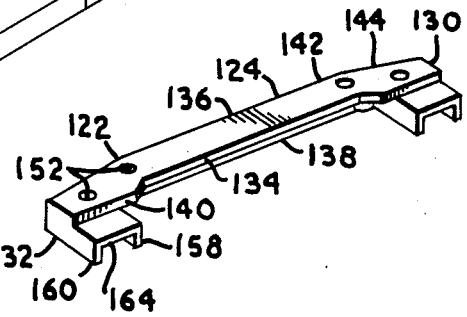
FIG. 2 is a top perspective view of an intersection cap mounting clip of the trim system.
Figure 3:
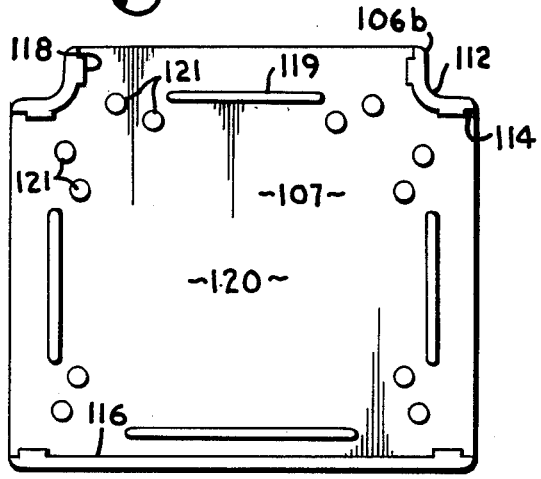
FIG. 3 is a bottom plan view of an intersection cap cover without the mounting clips.
Figure 4:
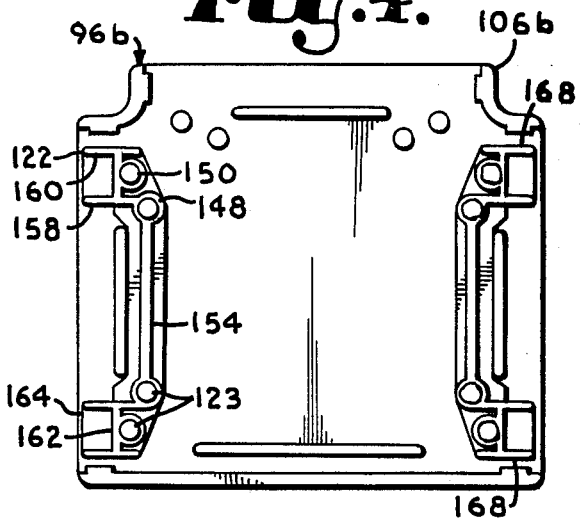
FIG. 4 is a bottom plan view of the intersection cap cover shown in FIG. 3, with two of its three mounting clips installed.

A pair of clip legs 156 are located adjacent the opposite clip ends 132 and project generally longitudinally outwardly therefrom and terminate in close proximity to the mouths of the end openings 114. Each clip leg 156 includes an inner rib or side wall 158 extending longitudinally from a respective inner pin boss 148 and an outer rib or side wall 160 extending longitudinally along a respective clip end 132. The ribs 158, 160 are interconnected by a transverse rib or side wall 162 connected to a respective outer pin boss 148 and generally positioned longitudinally outwardly from its pin receiver 152. Each clip leg 146 further includes a respective flange 164 bounded by the ribs 158, 160 and 162, each flange 164 being positioned slightly below the level of the clip base 124. As shown in FIGS. 2 and 5, each leg 156 has a generally channel-shaped configuration when viewed from a respective end opening 114.

The intersection caps **96*a*–96*d* can be produced by separately forming (e.g. by injection molding a suitable polymer, such as polypropylene) the covers 106*a*–106*d* and the mounting clips 122. The clips 122 can then be installed by inserting the mounting pins 121 in the receivers 152, whereby the pin distal ends 123 project slightly downwardly from the respective pin bosses 148, 150. The projecting pin distal ends 123 can then be enlarged, e.g. by heat deformation, to securely lock or thermally weld the mounting clips 122 in place. The mounting pins 121 can include proximate ends 125 with flared configurations for greater strength, and the pin receivers 152 can be correspondingly chamferred at the clip base upper surface 126 to accommodate such flared pin proximate ends 125**.

With the clips 122 thus mounted on the covers **106*a*–106*d* relatively narrow horizontal channels or slots 166 are formed between the leg flanges 164 and the cover lower surfaces 110. Relatively narrow vertical channels or slots 168 are formed between respective leg outer ribs 160 and adjacent portions of the cover perimeter side walls 112**.

The clip mitered corners 146 permit the clips 122 to be mounted within adjacent pairs of end openings 114 which are positioned in various angular relationships with respect to each other. For example, right angle or 90° sections occur in intersection caps **96*a*–96*c***.

In the 135° obtuse angle intersection cap **96*d*, a pair of mounting clips form an angle "C" of approximately 45° with respect to each other (FIG. 9). To accommodate this situation, the mitered corners 146 can be formed to deviate from the transverse line of the inner edge center portion 142 by an angle "D" equal to approximately 22.5° (obtuse angle A is approximately equal to 157.5°, i.e. 180° minus 22.5°). By placing a pair of the clips 122 with respective mitered corners 146 of each in juxtaposed relationship as shown in FIG. 9, an angle "C" of approximately 45° is formed by the clips 122, which, of course, corresponds to the angle of approximately 45° formed by the respective end openings 114 of a 135° obtuse angle intersection cap 96*d***.

For the right-angle intersection caps **96*a*–96*c*, the mitered corners 146 could be formed at approximately 45°, but by mitering all the corners 146 at approximately 22.5° as shown and described, all of the caps 96*a*–96*d* can be formed with common, universal clips 122**.

The staggered positioning of the pin bosses 148, 150 and the mounting pins 121 cooperates with the mitered corners 146 to facilitate forming the various inner section cap configurations as described above, and also provides a relatively secure and structural mounting of the clips 122 on the covers **106*a*–106*d*. In particular, since the mounting pins 121 are not aligned but rather are slightly spaced from each other longitudinally, the clips 122 tend to resist being rocked about their transverse axes under various loading conditions on the clip legs 156**.

The intersection caps 96 are adapted for connecting edge caps 170 and concealing their ends 172. The edge caps 170 can include pairs of opposed, parallel side flanges 174 interconnected by respective connecting flanges 176 forming channel-like cross-sectional configurations. Each edge cap 170 includes a pair of parallel, transversely spaced, longitudinally-extending female fastening strips 178 with configurations adapted to releasably grip the upper channel beaded edges 50 for releasable mounting.

Free, exposed panel side edges 36, 38 can be covered with edge caps 170 by attaching male adapter channels 180 with beaded edges 182 like the beaded edges 50 of the upper channels 46 to respective side channels 60 (FIG. 12). At inside corners 184, one of the edge cap ends 172 simply abuts the intersecting edge cap 170. At outside corners 186, 90°, radiused end caps 188 can be provided. Each end cap 188 includes two pairs of legs 190, one of the transversely-spaced pairs of legs being oriented approximately 90° with respect to the other transversely spaced pair of legs 190. The transverse spacing of the legs 190 and their configurations are substantially similar to those of the mounting clip legs 156. Each end cap 188 includes a cover 192 with a cross-sectional configuration generally comprising a quarter-circle, and cover ends 194 with corresponding, generally quarter-circular configurations.

Lower trim strips 196 are provided for mounting on the I-members 52 to enclose the lower raceways 54 and can include openings (not shown) for electrical outlets and the like.

As shown in FIG. 10, a gasket 216 is provided for closing gaps 218 formed between adjacent pairs of side standard quarter edges 65. Such gaskets 216 are particularly useful at four-way cross intersections **44*c*, where at the four respective side standards 60 do not meet, but form respective gaps 218 which could be seen through if not covered by gaskets 216. Each gasket 216 has a generally continuous longitudinal configuration and a cross-sectional configuration somewhat resembling a modified "X". The gasket 216 includes inner pairs of relatively short legs 220 and outer pairs of relatively long legs 222 interconnected by a median web 224. The gaskets are preferably formed of a flexible material, and are installed by squeezing the inner legs 220 together and inserting them through the gaps 218. The gasket inner legs 220 thus lie flush against the side standard return flanges 62 and the outer legs 222 lie flush against the side standard side flanges 64**.

Substantially continuous horizontal raceways 228 extend through the number channels 46 and through the panel intersections **44*a*–*g*. The horizontal raceways 228 communicate with vertical raceways 230 extending vertically adjacent to respective panel side edges 36, 38 at the panel intersections. The structural connecting subsystem 28 and the cover trim subsystem 30 are designed to maintain the continuity and communication of the lower, horizontal and vertical raceways 54, 228 and 230**, respectively to facilitate the placement of wires and cables for communications, computers, etc. therein.

The vertical raceway 230 at the three-way tee intersection **44*b* is enclosed on the outside by a vertical cover strip 232 which is retained in place by retaining clips 234 with laterally-extending tabs 236 which are received in the standard end slots 67 (FIG. 5**).

V. Installation and Operation.

The floor plan configuration of the wall panel system 20 can be laid out on a floor surface, for example, with chalk lines, tape measures, etc. Installation can begin at a wall connection or at a right angle intersection **44*a* for stability. A panel 26*a*–26*e* can be attached to a permanent wall 226 with a wall upper connecting member 76*f***.

Appropriate upper connecting members **76*a*–76*g* and lower connecting brackets 82*a*–82*e* are selected and installed to accommodate the conditions at various panel intersections 44*a*–44*g*** as required by the panel system configuration.

The feet 58 are threadably and vertically adjusted to level the wall panels **26*a*–26*e***.

The trim subsystem 30 can be applied after the structural connecting subsystem 28 is in place. At straight line intersections **44*g*, the edge cap ends 172** can abut each other at joints which generally do not require covering.

The intersection caps **96*a*–96*d* and the end caps 188 can be installed as the edge caps 170 are placed on the panels 26*a*–26*e*. The edge cap ends 172 can be inserted in the channels or slots 166, 168 at the cap end openings 114. The edge cap ends 172 can abut the stop bars 119 and can generally be retained by the clip legs 156 and the retainer lips 118. The edge caps 170 can be cut to length. With the intersection caps 96*a*–96*d* in place, the edge caps 170 can be snapped onto the upper channels 46 and the male adapter channels 180 by pressing downwardly or inwardly whereby the female fastening strips 178 snap over the channel beaded edges 50 and 182**.

It is to be understood that while certain forms of the present invention have been illustrated and described herein, it is not to be limited to the specific forms or arrangement of parts described and shown.

What is claimed and desired to be secured by Letters Patent is as follows:

1. A wall panel system, which includes:

(a) a pair of panels each including:

(1) an upper edge;

(2) a lower edge;

(3) opposite side edges;

(4) opposite faces;

(5) an upwardly-open channel extending longitudinally along a respective panel upper edge;

(6) a supporting leg extending downwardly from a respective lower edge and associated with a respective side edge;

(b) an upper connecting member including a pair of legs each adapted for mounting in a respective channel;

(c) a lower connecting bracket adapted to interconnect said legs;

(d) a trim system including:

(1) a pair of edge caps each releaseably mounted on a respective panel upper edge and each including an end;

(2) an intersection cap adapted for releaseably mounting on said edge caps over an inner-section of said panels;

(e) each said intersection cap including:

(1) a cap cover including upper and lower surfaces; and (2) a cap mounting clip positioned under said cap cover and including a base with an upper surface and a leg projecting outwardly from said base;

(f) clip mounting means mounting said clip on said cap cover with said base upper surface against said cap cover lower surface and said leg in spaced relation below said cap lower surface whereby an outwardly open cap cover slot is formed between said cap cover lower surface and said leg; and (g) said cap cover slot being adapted to receive one of said edge cap ends so that said cap cover slot being adapted to receive one of said edge cap ends so that a portion of said edge cap end adjacent said end underlies the portion of said cap cover lower surface forming said slot.

2. The intersection cap according to claim 1 wherein:

(a) said mounting clip includes a laterally spaced pair of said legs.

3. The intersection cap according to claim 2 wherein:

(a) said cap cover includes a top and a perimeter side wall depending downwardly therefrom, said side wall including first and second openings adapted to receive said edge cap ends.

4. The intersection cap according to claim 3 wherein:

(a) each said edge cap includes a connecting flange and a transversely-spaced pair of side flanges depending downwardly therefrom; and (b) said edge cap side walls being receivable between said legs and said perimeter side walls with said intersection cap mounted on said edge caps.

5. The intersection cap according to claim 1 wherein said clip mounting means includes:

(a) a transversely-spaced pair of mounting pins depending downwardly from said cover lower surface; and (b) said clip including a pair of receivers each adapted to receive a respective mounting pin.

6. The intersection cap according to claim 5 wherein:

(a) each said mounting pin protrudes downwardly from said mounting clip and terminates at a distal end; and (b) each said mounting pin distal end is enlarged whereby said mounting clip is secured on said cover.

7. The intersection cap according to claim 1, which includes:

(a) a right-angle configuration for a right-angle panel intersection with first and second end openings oriented at approximately ninety degress with respect to each other and first and second mounting clips associated with said intersection cap first and second end openings respectively.

8. The intersection cap according to claim l, which includes:

(a) a T-shaped configuration for a straight line intersection of said first and second panels and right-angle intersections between said first and second panels and a third panel;

(b) first, second and third end openings, said first and second end openings being oriented in longitudinally aligned relation with respect to each other and said third end opening being oriented at approximately ninety degree relationships with respect to said first and second ends; and (c) first, second and third mounting clips associated with said first, second and third end openings respectively.

9. The intersection cap according to claim 1, which includes:

(a) a cross configuration adapted for covering a four-way intersection of first and second panels aligned in a straight line and third and fourth panels aligned in a straight line at substantially right angles to the first and second panels;

(b) first, second, third and fourth end openings; and (c) first, second, third and fourth mounting clips each associated with a respective cover end opening.

10. The intersection cap according to claim 1, which includes:

(a) an obtuse angular configuration adapted for covering the intersection of said first and second walls forming an angle of approximately one hundred and thirty-five degrees;

(b) first and second end openings, said first and second end openings being oriented at approximately one hundred and thirty-five degrees with respect to each other; and (c) first and second mounting clips associated with said first and second end openings respectively.

11. The wall panel system according to claim 1, which includes:

(a) a substantially continuous raceway extending through said channels and across said panel innersection, said raceway being partly enclosed by said edge and innersection caps.

12. The wall panel system according to claim 11, which includes:

(a) a vertical raceway extending between said adjacent panel side edges and communicating with said horizontal raceway.

13. In combination with a wall panel system including: first and second panels each having upper, lower and opposite side edges and opposite faces; said panels being connected whereby respective side edges of each are adjacent each other; and first and second edge caps mounted on the first and second panel upper edges respectively and terminating at first and second edge cap ends respectively, the improvement of an intersection cap, which comprises:

(a) a cap cover including upper and lower surfaces;

(b) a cap mounting clip including:

(1) a base with an upper surface; and (2) a leg projecting outwardly from said base and positioned in spaced relation below said base upper surface;

(c) clip mounting means mounting said clip on said cap cover with said base upper surface against said cap cover lower surface and said leg in spaced relation below said cap lower surface whereby an outwardly open cap slot is formed between said cover lower surface and said leg; and (d) said cap slot being adapted to receive one of said edge cap ends; and (e) said clip mounting means including:

(1) a transversely-spaced pair of mounting pins depending downwardly from said cover lower surface; and (2) said clip including a pair of receivers adapted to receive a respective mounting pin.

14. A trim system for a wall panel system including multiple panels with upper, lower and opposite side edges and opposite faces, the panels being adapted for interconnection with respective side edges positioned adjacent to each other at intersections which can have right angle, three-way tee, four-way cross and one hundred and thirty-five degree obtuse angle alternative configurations, which trim system includes:

(a) a right angle intersection cap including a cover having a pair of end openings disposed at substantially ninety degree orientations with respect to each other;

(b) a three-way tee intersection cap having a cover with first and second opposite end openings and a third end opening disposed in substantially 90° relationships with respect to said first and second openings;

(c) a four-way cross intersection cap having a cover with first and second opposed pairs of end openings substantially aligned on axes that cross each other at substantially 90° angles;

(d) an obtuse angle intersection cap including a cover with a pair of end openings disposed at substantially one hundred and thirty-five degree orientations with respect to each other;

(e) each said cover including a cover top with upper and lower surfaces and a perimeter side wall including said end openings and terminating at a lower margin, each said cover forming a cavity which is open downardly and at said end openings;

(f) each said intersection cap including a plurality of mounting clips each positioned within a respective cavity and associated with a respective intersection cap end opening, each said clip including:

(1) a base mounted on a respective cover top lower surface and including a pair of opposite ends;

(2) a pair of legs each mounted on and extending outwardly from a respective clip base in spaced relation below a respective cover top, said legs being in transversely spaced relation and each associated with a respective side of said end opening; and (3) each said intersection cover forming a plurality of edge cap end receivers each associated with a respective end opening;

(g) a plurality of edge caps each mounted on a respective panel upper edge and including an end associated with a respective intersection, each said edge cap end being adapted to be received in a respective cap end receiver; and (h) each said intersection cap including:

(1) a pair of mounting pins depending downwardly from said cover top of the lower surface into said cavity; and (2) each said mounting clip base including a pair of mounting pin receivers each adapted to receive a respective mounting pin.

15. The trim system according to claim 14, wherein each said clip base includes:

(a) a mitered inner side corner.

16. The trim system according to claim 15, wherein each said mounting clip base includes:

(a) an inner, transversely-extending edge; and (b) said mitered corners forming obtuse, included angles of approximately 157.5° with respect to said base inner ridge.

17. The trim system according to claim 16, wherein said obtuse angle intersection cap includes:

(a) said pair of mounting clips being positioned with respective mitered corners positioned in just opposed relation whereby said clip inner ridges form an included angle approximately 45° with respect to each other.

18. The trim system according to claim 16, wherein:

(a) each said mounting pin includes a distal end projecting downwardly from a respective mounting clip base; and (b) said pin distal ends are enlarged whereby said mounting clips are retained on said cap covers.

19. The trim system according to claim 14, which includes:

(a) said pair of mounting pins comprises an inner pair of pins;

(b) an outer pair of mounting pins depending downwardly from each said cap cover top lower surface into a respective said cavity in association with each said cover and opening;

(c) said mounting clip pin receivers comprising an inner pair of pin receivers; and (d) each said mounting clip base including an outer pair of pin receivers adapted to receive a respective outer pair of mounting pins.

20. The trim system according to claim 14, wherein each said mounting clip leg includes:

(a) a transversely-spaced pair of ribs; and (b) a horizontal flange positioned on top of and interconnecting said ribs, said flange being adapted to engage a respective edge cap end.

21. The trim system according to claim 14, wherein each said cover includes:

(a) a plurality of stop bars each associated with a respective end opening and extending transversely in parallel, inwardly-spaced relation with respect thereto, each said stop bar depending downwardly from said cap cover top lower surface and being adpated to engage a respective edge cap end.

22. The trim system according to claim 14, which includes:

(a) an edge cap mounted on a respective panel side edge and including an end associated with an outside corner of a respective panel; and (b) an outside corner edge cap including a horizontal pair of legs adapted to releaseably engage said edge cap on said panel upper edge associated with said outside corner and a pair of downwardlydepending vertical legs adapted to engage said edge cap mounted on said side edge at said outside corner, and said end cap including a cover with a configuration comprising a quartercircle.

23. The trim system according to claim 14, wherein:

(a) said edge cap includes a pair of longitudinally-extending, parallel fastening strips with downwardly-open channels; and (b) each said panel includes an upper channel with a pair of longitudinally-extending, parallel beaded edges adapted for releaseable retention in said fastening strip channels.

24. The trim system according to claim 14, wherein said gasket includes:

(a) an inner pair of relatively short legs adapted to engage said panels on one side of said gap;

(b) a pair of relatively long legs adapted to engage said panels on the other side of said gap; and (c) a web extending across said gap between one set of inner and outer legs and the other set of inner and outer legs.

25. In combination with a wall panel system including: first and second panels each having upper, lower and opposite side edges and opposite faces; said panels being connected whereby respective side edges of each are adjacent to each other; and first and second edge caps each including a connecting flange and a transversely-spaced pair of side flanges depending downwardly therefrom, said edge caps being mounted on the first and second panel upper edges respectively and terminating at first and second edge cap ends respectively, the improvement of an intersection cap, which comprises:

(a) a cap cover including:

(1) a top with upper and lower surfaces;

(2) a perimeter sidewall depending downwardly from said top; and (3) first and second openings in said perimeter sidewall, each set opening being adapted to receive a respective edge cap end;

(b) a cap mounting clip positioned within said cap cover and including:

(1) a base with an upper surface; and (2) a laterally-spaced pair of legs projecting outwardly from said base;

(c) clip mounting means mounting said clip on said cap cover with said base upper surface against said cap cover top lower surface and said legs in spaced relation below said cap top lower surface thereby an outwardly open cap cover slot is formed between said cap cover top lower surface and said legs; and (d) said edge cap sidewalls being receivable between said legs and said cap cover perimeter sidewalls with said intersection cap mounted on said edge caps; and (e) said cap cover slot being adapted to receive one of said edge cap ends so that a portion of said edge cap end adjacent said end underlies the portion of said cap cover lower surface forming said slot.

26. A trim system for a wall panel system including multiple panels with upper, lower and opposite side edges and opposite faces, the panels being adapted for interconnection with respective side edges positioned adjacent to each other at intersections which can have right angle, three-way tee, four-way cross and one hundred and thirty-five degree obtuse angle alternative configurations, which trim system includes:

(a) a right angle intersection cap including a cover having a pair of end openings disposed at substantially ninety degree orientations with respect to each other;

(b) a three-way tee intersection cap having a cover with first and second opposite end openings and a third end opening disposed in substantially 90° relationships with respect to said first and second openings;

(c) a four-way cross intersection cap having a cover with first and second opposed pairs of end openings substantially aligned on axes that cross each other at substantially 90° angles;

(d) an obtuse angle intersection cap including a cover with a pair of end openings disposed at substantially one hundred and thirty-five degree orientations with respect to each other;

(e) each said cover including a cover top with upper and lower surfaces and a perimeter side wall including said end openings and terminating at a lower margin, each said cover forming a cavity which is open downwardly and at said end openings;

(f) each said intersection cap including a plurality of mounting clips each positioned within a respective cavity and associated with a respective intersection cap end opening, each said clip including:

(1) a base mounted on a respective cover top lower surface and including a pair of opposite ends;

(2) a pair of legs each mounted on and extending outwardly from a respective clip base in spaced relation below a respective cover top, said legs being in transversely spaced relation and each associated with a respective side of said end opening; and (3) each said intersection cover forming a plurality of edge cap end receivers each associated with a respective end opening;

(g) a plurality of edge caps each mounted on a respective panel upper edge and including an end associated with a respective intersection, each said edge cap end being adapted to be received in a respective cap end receiver; and (h) a plurality of stop bars each associated with a respective end opening and extending transversely in parallel, inwardly-spaced relation with respect thereto, each said stop bar depending downwardly from said cap cover top lower surface and being adapted to engage a respective edge cap end.

27. The trim system according to claim 16, wherein each said intersection cap includes:

(a) a pair of mounting pins depending downwardly from said cover top of the lower surface into said cavity; and (b) each said mounting clip base including a pair of mounting pin receivers each adapted to receive a respective mounting pin.

28. A trim system for a wall panel system including multiple panels with upper, lower and opposite side edges and opposite faces, the panels being adapted for interconnection with respective side edges positioned adjacent to each other at intersections which can have right angle, three-way tee, four-way cross and one hundred and thirty-five degree obtuse angle alternative configurations, which trim system includes:

(a) a right angle intersection cap including a cover having a pair of end openings disposed at substantially ninety degree orientations with respect to each other;

(b) a three-way tee intersection cap having a cover with first and second opposite end openings and a third end opening disposed in substantially 90° relationships with respect to said first and second openings;

(c) a four-way cross intersection cap having a cover with first and second opposed pairs of end openings substantially aligned on axes that cross each other at substantially 90° angles;

(d) an obtuse angle intersection cap including a cover with a pair of end openings disposed at substantially one hundred and thirty-five degree orientations with respect to each other;

(e) each said cover including a cover top with upper and lower surfaces and a perimeter side wall including said end openings and terminating at a lower margin, each said cover forming a cavity which is open downwardly and at said end openings;

(f) each said intersection cap including a plurality of mounting clips each positioned within a respective cavity and associated with a respective intersection cap end opening, each said clip including:

(1) a base mounted on a respective cover top lower surface and including a pair of opposite ends;

(2) a pair of legs each mounted on and extending outwardly from a respective clip base in spaced relation below a respective cover top, said legs being in transversely spaced relation and each associated with a respective side of said end opening; and (3) each said intersection cover forming a plurality of edge cap end receivers each associated with a respective end opening;

(g) a plurality of edge caps each mounted on a respective panel upper edge and including an end associated with a respective intersection, each said edge cap end being adapted to be received in a respective cap end receiver; and (h) said edge cap including a pair of longitudinally-extending, parallel fastening strips with downwardly-open channels; and (i) each said panel including an upper channel with a pair of longitudinally-extending, parallel beaded edges adapted for releaseable tension in said fastening strip channels.

29. A trim system for a wall panel system including multiple panels with upper, lower and opposite side edges and opposite faces, the panels being adapted for interconnection with respective side edges positioned adjacent to each other at intersections which can have right angle, three-way tee, four-way cross and one hundred and thirty-five degree obtuse angle alternative configurations, which trim system includes:

(a) a right angle intersection cap including a cover having a pair of end openings disposed at substantially ninety degree orientations with respect to each other;

(b) a three-way tee intersection cap having a cover with first and second opposite end openings and a third end opening disposed in substantially 90° relationships with respect to said first and second openings;

(c) a four-way cross intersection cap having a cover with first and second opposed pairs of end openings substantially aligned on axes that cross each other at substantially 90° angles;

(d) an obtuse angle intersection cap including a cover with a pair of end openings disposed at substantially one hundred and thirty-five degree orientations with respect to each other;

(e) each said cover including a cover top with upper and lower surfaces and a perimeter side wall including said end openings and terminating at a lower margin, each said cover forming a cavity which is open downwardly and at said end openings;

(f) each said intersection cap including a plurality of mounting clips each positioned within a respective cavity and associated with a respective intersection cap end opening, each said clip including:

(1) a base mounted on a respective cover top lower surface and including a pair of opposite ends;

(2) a pair of legs each mounted on and extending outwardly from a respective clip base in spaced relation below a respective cover top, said legs being in transversely spaced relation and each associated with a respective side of said end opening; and (3) each said intersection cover forming a plurality of edge cap end receivers each associated with a respective end openings;

(g) a plurality of edge caps each mounted on a respective panel upper edge and including an end associated with a respective intersection, each said edge cap end being adapted to be received in a respective cap end receiver; and (h) each said panel having a vertically-extending corner edge and a vertically-extending gap formed between the corner edges of a respective pair of interconnected panels; and (i) gasket means adapted for releaseable engagement with said interconnected panels at their respective corner edges for closing said gap.

* * * * *